US006945291B2

(12) United States Patent
Chuang

(10) Patent No.: US 6,945,291 B2
(45) Date of Patent: Sep. 20, 2005

(54) DEVICE FOR ELIMINATING A GAP OF THE THREADED ROD OF A PLANE MACHINE

(76) Inventor: Bor Yann Chuang, No. 78, Yungfeng Rd., Taiping Shiang, Taichung 411 (TW)

( * ) Notice: Subject to any disclaimer, the term of this patent is extended or adjusted under 35 U.S.C. 154(b) by 102 days.

(21) Appl. No.: 10/642,830

(22) Filed: Aug. 19, 2003

(65) Prior Publication Data

US 2005/0039823 A1 Feb. 24, 2005

(51) Int. Cl.[7] ..... B27C 1/02

(52) U.S. Cl. ..... 144/117.1; 144/129; 144/130; 409/218

(58) Field of Search ..... 144/114.1, 117.1, 144/117.4, 129, 130; 30/475; 409/206, 210, 218–220

(56) References Cited

U.S. PATENT DOCUMENTS 5,725,035 A * 3/1998 Shadeck ..... 144/117.1
5,816,303 A * 10/1998 Shadeck ..... 144/373
5,957,174 A * 9/1999 Shadeck ..... 144/117.1
6,279,628 B1 * 8/2001 Chang ..... 144/130
6,481,474 B1 * 11/2002 Liao et al. ..... 144/252.1

* cited by examiner

*Primary Examiner*—Derris H. Banks
*Assistant Examiner*—Shelley Self
(74) *Attorney, Agent, or Firm*—Troxell Law Office, PLLC

(57) ABSTRACT

A device for eliminating a gap of the threaded rod of a plane machine has four gap nuts respectively screwed with four threaded rods under the threaded rod bases of a planing table. Four springs are respectively fitted between the backlash nuts and the threaded rod bases. When the gap nuts are screwed upward, the springs are pressed to produce a pushing-up force to push against the threaded rod bases and the planing table, and the pushing-up force is greater than the total weight of the rod bases and the table. Thus, the threaded rod bases can be pushed by the springs to move upward and closely contact the threaded rods to eliminate a gap therebetween, stabilizing the table and the planning knife to perform planing precisely and elevate the quality of planing.

2 Claims, 8 Drawing Sheets

DEVICE FOR ELIMINATING A GAP OF THE THREADED ROD OF A PLANE MACHINE

BACKGROUND OF THE INVENTION

1. Field of the Invention

This invention relates, to a device for eliminating a gap of the threaded rod of a plane machine, particularly to one able to stabilize the planing table of a plane machine during planing so as to carry out planing smoothly and precisely and elevate the quality of planing.

2. Description of the Prior Art

A conventional plane machine, as shown in FIG. 1, includes a bottom base 11, four threaded rods 12 and a planing table 13 combined together. The four threaded rods 12 are respectively fixed at the four corners of the bottom base 11, extending upward and screwed through the planing table 13. The planing table 13 able to be moved up and down is provided thereon with a planing knife for carrying out planing of wood materials. The planing table 13 has four threaded rod bases 131 respectively fixed at its four corners and screwed with the four threaded rods 12, enabling the planing table 13 to move up and down along the threaded rods 12.

However, as shown in FIG. 2, the threaded rod base 131 of the planing table 13 has its inner threads 1311 screwed with the outer threads 121 of the threaded rod 12; therefore backlash (a) of different sizes may form between the inner threads 1311 and the outer threads 121. Further, the planing table 13 has a certain weight so the inner threads 1311 of the threaded rod base 131 may be forced by the weight of the planing table 13 to press the upper side of the outer threads 121 of the threaded rod 12, forming a gap (a) between the inner and the outer threads 1311 and 121 above the inner threads 1311. On the other hand, when the planing machine carries out planing, the wood material being planed will produce a reverse pushing-up force to push against the planing knife and the planing table 13. As there forms the gap (a) between the inner threads 1311 of the threaded rod base 131 of the planing table 13 and the outer threads 121 of the threaded rod 12, the planing table 13 together with the threaded rod base 131 will be actuated by the reverse pushing force of the wood material to move upward for nearly the distance of the gap (a), if the reverse pushing force pushing against the planing table 13 is greater than the total weight of the planing table 13. At this time, the planing position of the planing knife 14 will become a bit higher than the original one by the distance of a gap (b), and the planing surface of the wood to be planed subsequently will become a little more bulgy than the original one, resulting in an uneven planing surface 151, as shown in FIG. 3. And such an uneven planing surface 151 will always appear especially when the planing table 13 is frequently moved up and down or has been employed for long to render the inner threads 1311 of the threaded rod base 131 and the outer threads 121 of the threaded rod 12 worn off seriously. Apparently, it is of great importance to solve the problem of the gap formed between the threads of the threaded rod base 131 and the threaded rod 12 so as to stabilize the planing table 13 in a planing process and elevate the quality of planing.

SUMMARY OF THE INVENTION

The objective of the invention is to offer a device for eliminating a gap of the threaded rod of a planing machine, provided with four gap nuts respectively screwed with four threaded rods. Four springs respectively fitted around the four threaded rods and positioned on the four backlash nuts are pressed to produce a pushing-up force to move a threaded rod base upward and closely contact with the four threaded rods to eliminate the gap therebetween, able to stabilize the planing table and the planing knife thereon to carry out planing smoothly and precisely and elevate the quality of planing.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
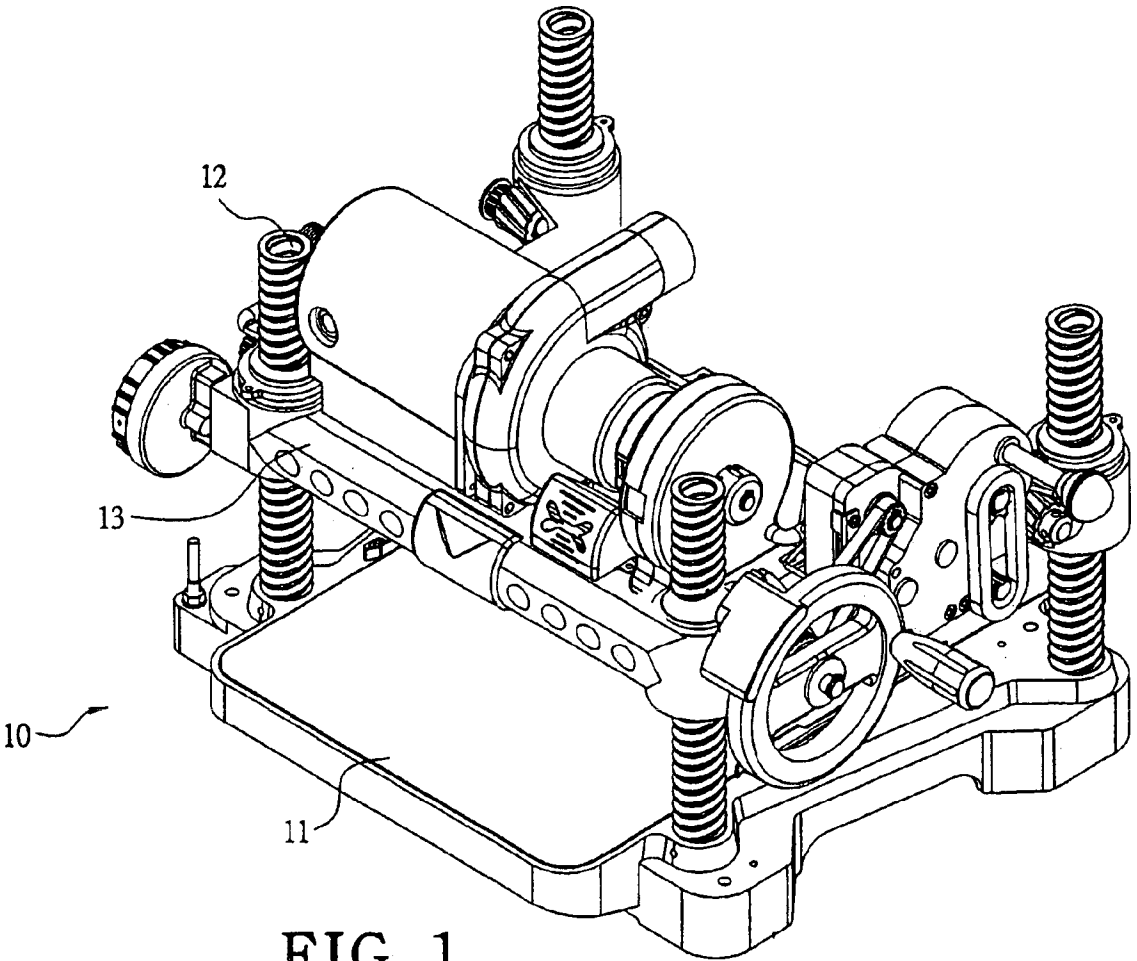
FIG. 1 PRIOR ART
FIG. 1 is a perspective view of a conventional plane machine.
Figure 2:
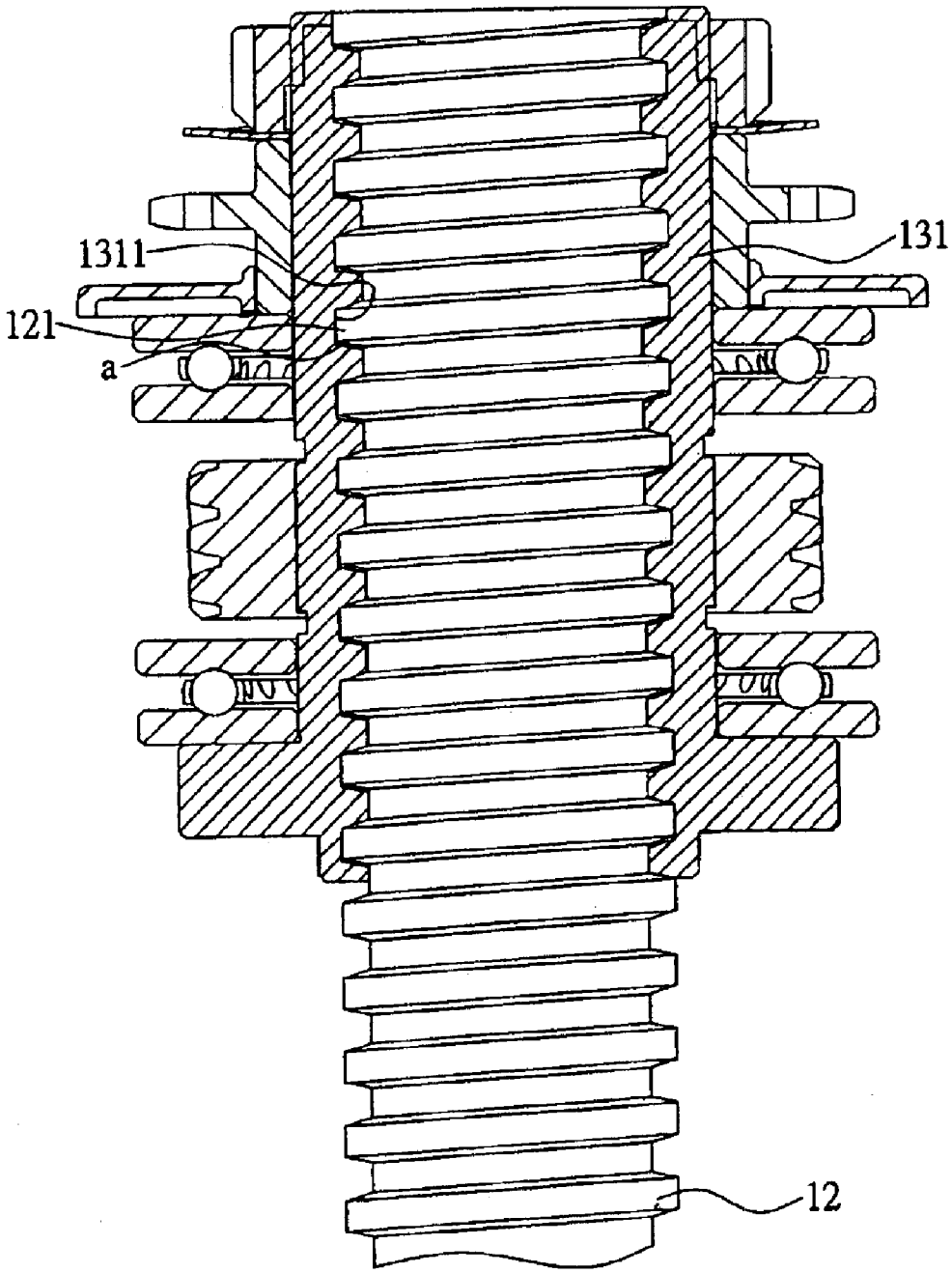
FIG. 2 PRIOR ART
FIG. 2 is a cross-sectional view of the threaded rod base screwed together with the threaded rod of the conventional plane machine.
Figure 3:
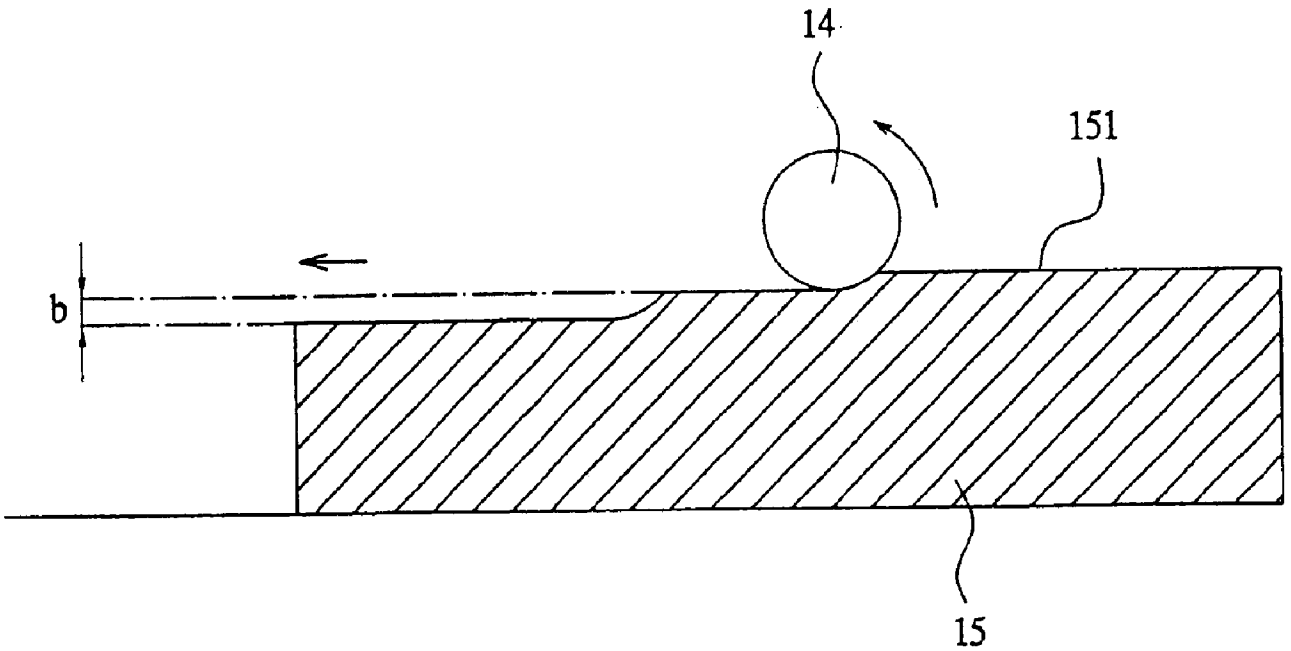
FIG. 3 PRIOR ART
FIG. 3 is a side-sectional view of a planing condition of the conventional plane machine, showing a gap affecting the planing of a wood material.
Figure 4:
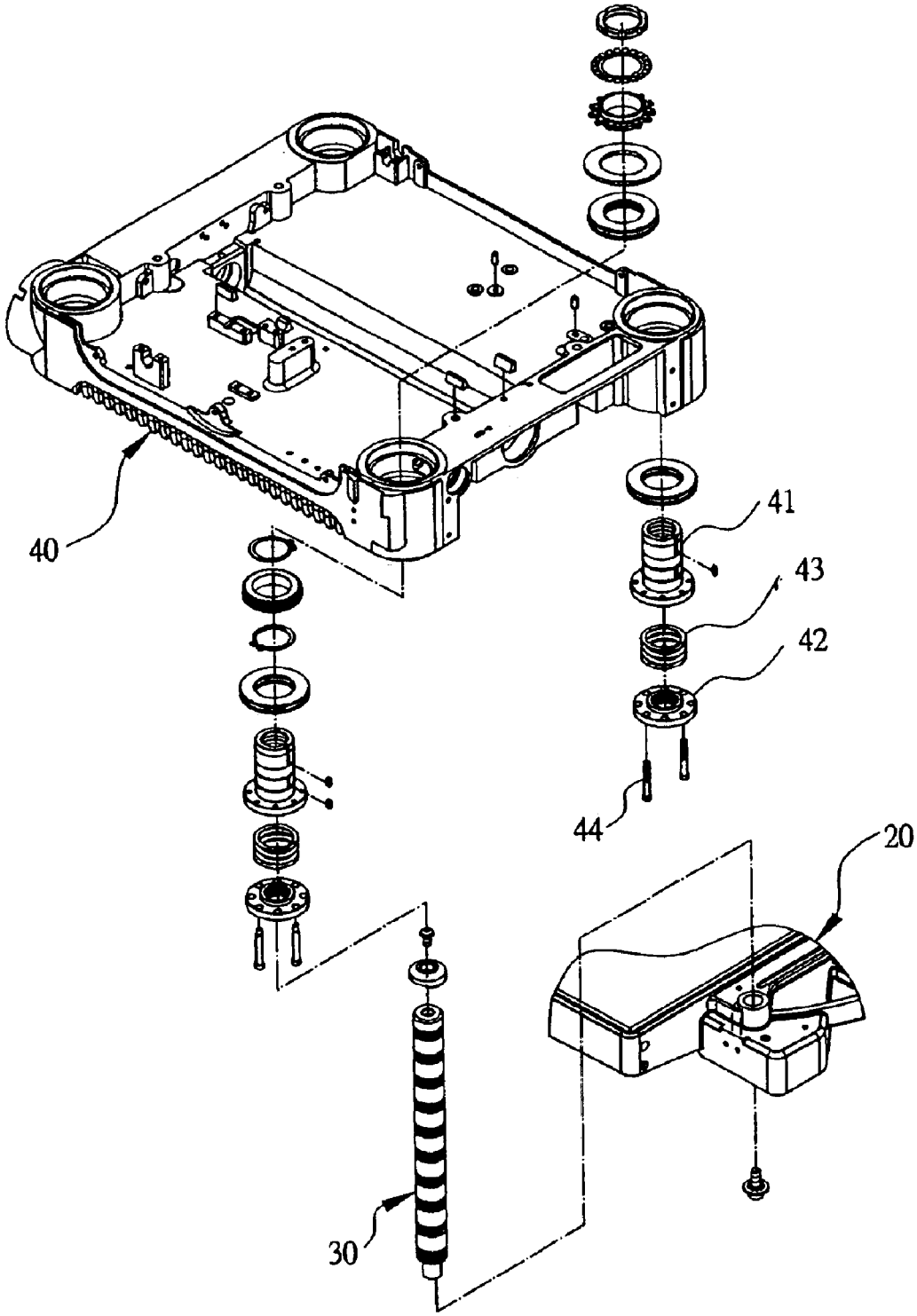
FIG. 4 is a partial exploded perspective view of a planing machine in the present invention.
Figure 5:
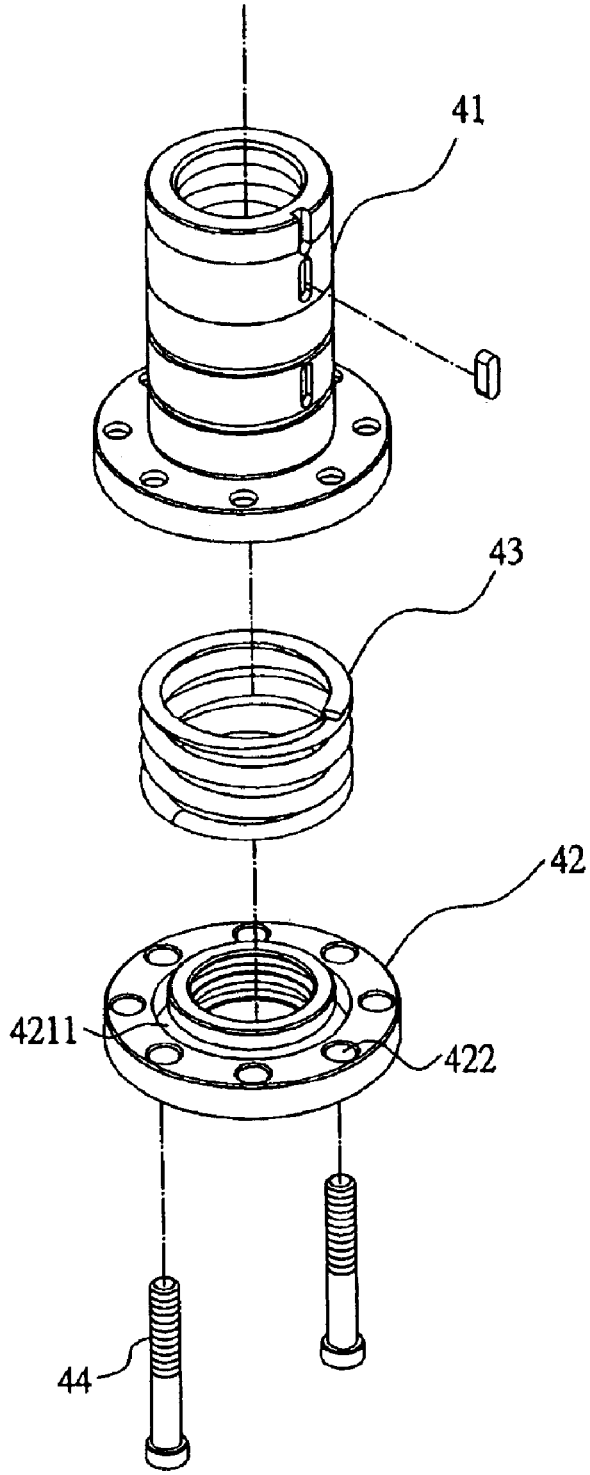
FIG. 5 is an exploded perspective view of the related components of the threaded rod base of the planing machine in the present invention.
Figure 6:
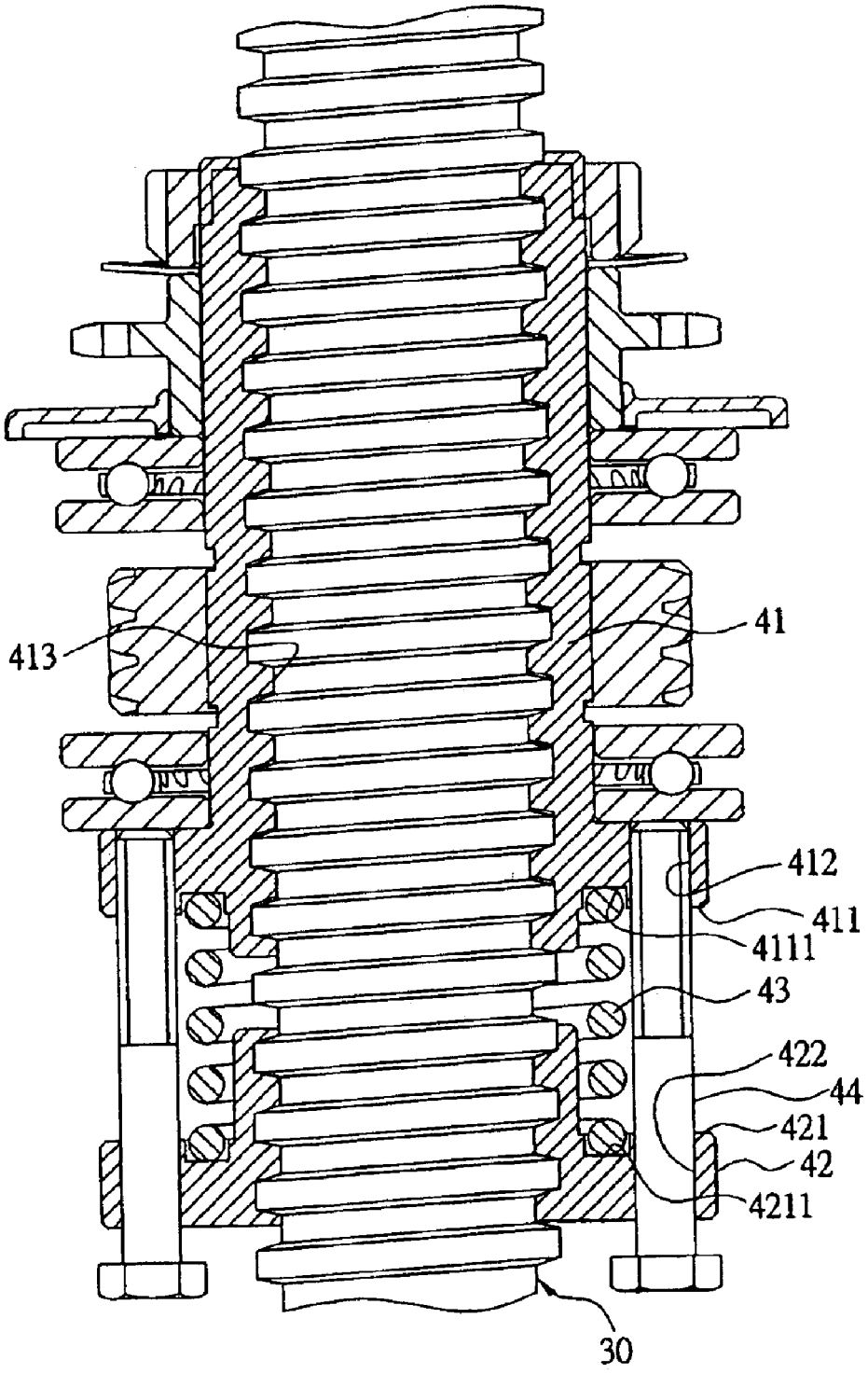
FIG. 6 is a cross-sectional view of the threaded rod base screwed together with the threaded rod of the planing machine in the present invention.

A preferred embodiment of a device for eliminating a gap of the threaded rod of a plane machine in the present invention, as shown in FIGS. 4 to 6, includes a bottom base 20, four threaded rods 30, a planing table 40 and four gap nuts 42 combined together.

The bottom base 20 has its four corners respectively fixed with the threaded rod 30 extending upward and respectively screwed with the four threaded rod bases 41 secured at the four corners of the planing table 40, rendering the planing table 40 adjustable to move up and down.

The four gap nuts 42 are respectively screwed with the four threaded rods 30 under the threaded rod bases 41. Four springs 43 are respectively fitted between the four gap nuts 42 and the four threaded rod bases 41, able to be pressed tight by the gap nuts 42. The gap nuts 42 and the threaded rod bases 41 are positioned together by bolts to prevent the gap nuts 42 from loosening and turning around.

In addition, each threaded rod base 41 and each backlash nut 42 respectively has its outer circumferential edge formed with an annular spring holder 411 and 421 protruding downward and upward, and the annular spring holder 411 and 421 respectively have their surface bored with a spring receiving groove 4111 and 4211 for receiving the opposite ends of the spring 43. Further, the spring holder 411 of the threaded rod base 41 has two locking threaded holes 412 respectively bored in the opposite sides of its circumferential surface, and the spring holder 421 of the gap nut 42 has its circumferential surface bored with positioning holes 422 preset in number, with any two of the positioning holes 422 able to face the two locking threaded holes 412. Two locking bolts 44 are respectively screwed in both the positioning holes 422 and the locking threaded holes 412 to combined the gap nut 42 together with the threaded rod base 41 so as to prevent the gap nut 42 from loosening and turning around when the threaded rod 30 is turned to move the planing table 40 up and down.

Figure 7:
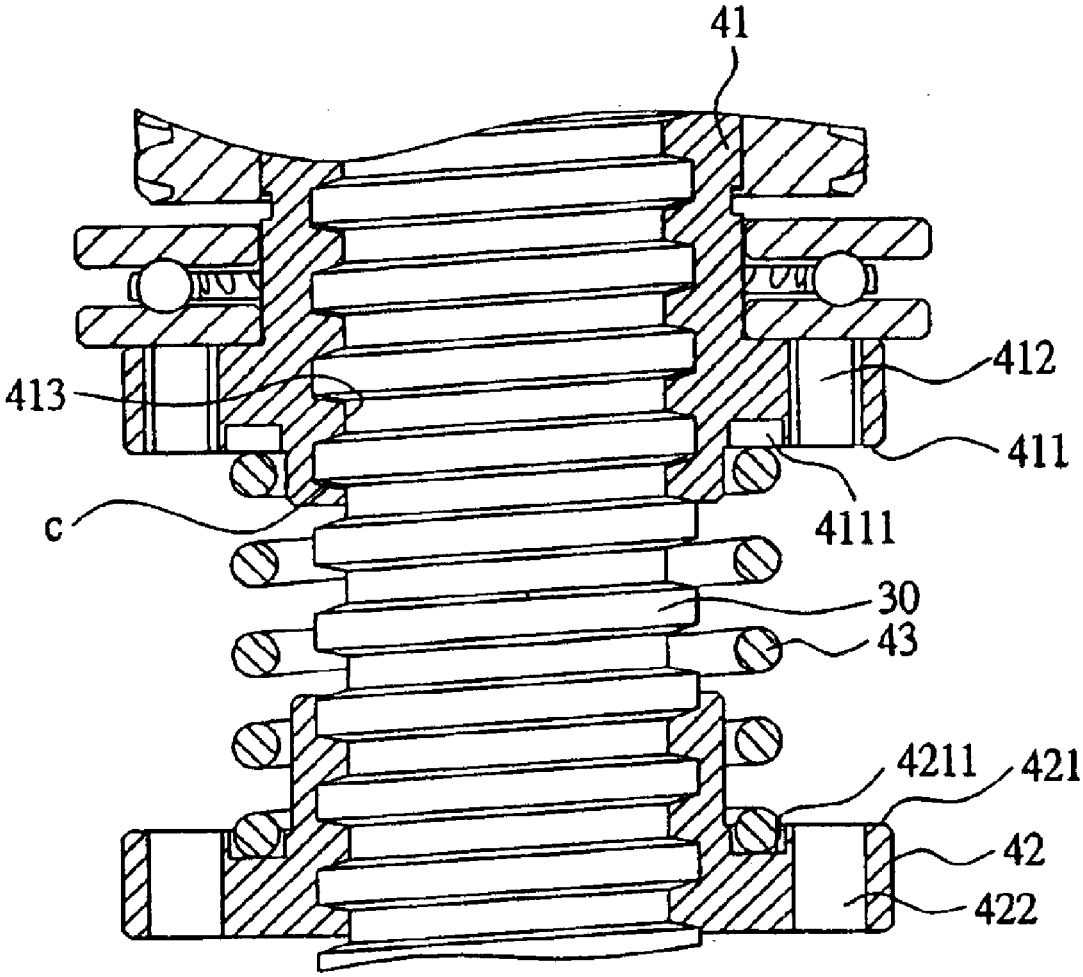
FIG. 7 is a cross-sectional view of a device for eliminating a gap of the threaded rod of a plane machine in the present invention, showing the device in an unlocked position.
Figure 8:
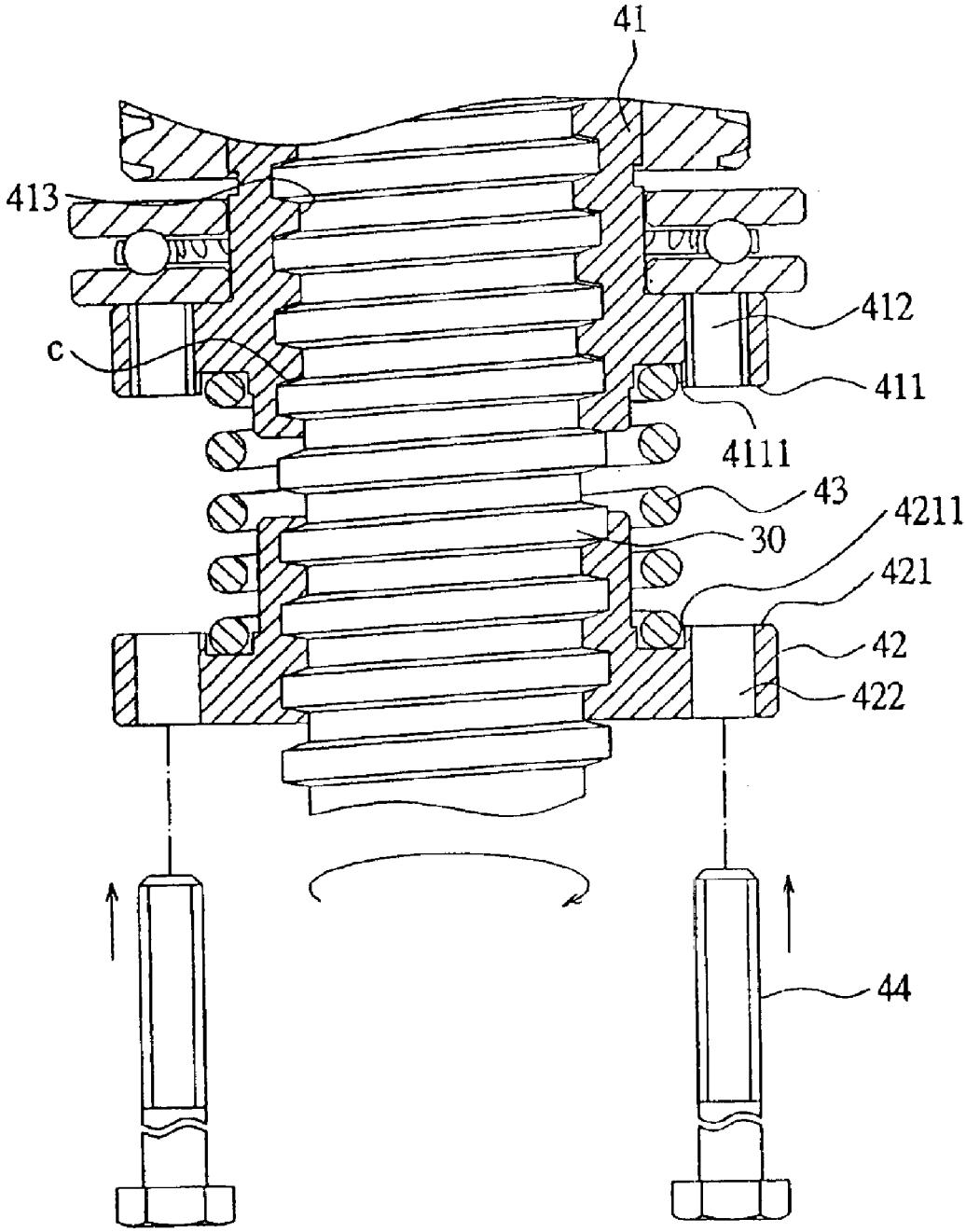
FIG. 8 is a cross-sectional view of the device for eliminating a gap of the threaded rod of the planing machine in the present invention, showing the device in a locked position.

The device for eliminating a gap of the threaded rod of a plane machine in the present invention, as shown in FIG. 6 to 8, is adjusted to function mainly by the four gap nuts 42. To make adjustment, the locking bolts 44 are first unscrewed from the gap nuts 42 and then the gap nuts 42 are screwed to a needed position. Generally, when the gap nut 42 is tightly screwed with the threaded rod base 41, each spring 43 fitted on the threaded rod 43 can produce a pushing-up force of about 20 kg so four springs 43 can produce a total pushing-up force of about 80 kg, and the planing table 40 weighs about 30 kg. Therefore, the surplus pushing-up force of 50 kg of the springs 43 is sufficient to push the threaded rod base 41 to move upward and contact closely with the threaded rod 30, thus able to eliminate backlash of the threaded rod 30. In case the threaded rods 30 are turned too tight, the gap nuts 42 can be released to a proper extent to facilitate the planing table 40 moved up and down.

Besides, after the four gap nuts 42 are screwed in position and the four springs 43 are pressed to produce a proper pushing-up force, the gap nuts 42 are locked in position with the threaded rod bases 41 by means of two bolts 44 to prevent the gap nuts 42 from loosening and turning around. As can be noted from the above description, the pushing-up force of the springs 43 can push the threaded rod base 41 and the planing table 40 move upward to eliminate the gap (c) between the lower surface of the outer threads 31 of the threaded rod 30 and the upper surface of inner threads 413 of the threaded rod base 41. Thus, the planing table 40 can be lifted upward and positioned closely on the four threaded rods 30; therefore when the plane machine perform planing of a wood material and the wood material produces a reverse pushing force to push against the planing knife, the planing table 40 cannot be moved upward by such a reverse pushing force, no matter how huge it is, capable to stabilize the planing table 40 in a planing process and let the wood material planed smoothly and precisely. Additionally, even though the threads of the threaded rod 30 and the threaded rod base 41 become worn off to form a gap therebetween due to repeated screwing, the gap still can be eliminated by the device of this invention, able to maintain excellent quality of planing.

While the preferred embodiment of the invention has been described above, it will be recognized and understood that various modifications may be made therein and the appended claims are intended to cover all such modifications that may fall within the spirit and scope of the invention.

I claim:

1. A device for eliminating a gap of the threaded rod of a plane machine comprising: a bottom base, said bottom base having four corners, each of the four corners respectively fixed with one of four threaded rods extending upward, said four threaded rods respectively screwed with four threaded rod bases provided at the four corners of a planing table, said planing table adjustable to move up and down;

wherein four gap nuts are respectively screwed with said four threaded rods under said threaded rod base, four springs are respectively fitted between said gap nuts and said threaded rod bases, said springs pressed tight when said gap nuts are screwed upwardly, said gap nuts screwed together with said threaded rod bases by bolts to prevent said gap nuts from loosening and turning around;

wherein each of the four gap nuts are screwed upwardly to press each said spring to push against said threaded rod base, said threaded rod base having its inner threads moved upward to closely push against the outer threads of each said threaded rod, the gap between said inner threads of said threaded rod base and said outer threads of said threaded rod able to be eliminated, said planing table able to be stabilized to carry out planing smoothly and precisely; and wherein said threaded rod base and each of the four gap nuts respectively have an annular spring holder formed at the outer circumferential surface for two ends of said spring to be positioned thereon, said annular spring holder of each said threaded rod base and each of the four gap nuts are respectively bored with locking threaded holes and positioning holes preset in number, at least one of said positioning holes aligned to one said locking threaded hole, a bolt inserted in both said positioning hole and said locking threaded hole to combine each of the four gap nuts together with one of the four threaded rod bases.

2. A device for eliminating a gap of the threaded rod of a plane machine comprising: a bottom base, said bottom base having four corners, each of the four corners respectively fixed with one of four threaded rods extending upward, said four threaded rods respectively screwed with four threaded rod bases provided at the four corners of a planing table, said planing table adjustable to move up and down;

wherein four gap nuts are respectively screwed with said four threaded rods under said threaded rod base, four springs are respectively fitted between said gap nuts and said threaded rod bases, said springs pressed tight when said gap nuts are screwed upwardly, said gap nuts screwed together with said threaded rod bases by bolts to prevent said gap nuts from loosening and turning around;

wherein each of the four gap nuts are screwed upwardly to press each said spring to push against said threaded rod base, said threaded rod base having its inner threads moved upward to closely push against the outer threads of each said threaded rod, the gap between said inner threads of said threaded rod base and said outer threads of said threaded rod able to be eliminated, said planing table able to be stabilized to carry out planing smoothly and precisely; and wherein each of the four threaded rod bases and each of the four gap nuts respectively have an annular spring holder bored with an annular spring receiving groove for receiving the two ends of said spring.

* * * * *